US005080617A

United States Patent [19]

Broughton et al.

[11] Patent Number: 5,080,617

[45] Date of Patent: Jan. 14, 1992

[54] MARINE PROPULSION DEVICE WITH DIRECTABLE TELLTALE DISCHARGE

[75] Inventors: George L. Broughton, Zion, Ill.; Paul W. Breckenfeld, Kenosha, Wis.

[73] Assignee: Outboard Marine Corporation, Waukegan, Ill.

[21] Appl. No.: 525,862

[22] Filed: May 18, 1990

[51] Int. Cl.[5] ..... B63H 21/26

[52] U.S. Cl. ..... 440/2; 440/88

[58] Field of Search ..... 440/88, 89, 2, 40–43; 239/587, 600

[56] References Cited

U.S. PATENT DOCUMENTS

| | | | |
|---|---|---|---|
| 1,824,736 | 9/1931 | Johnson et al. | 440/88 X |
| 3,054,375 | 9/1962 | Neely | 440/41 |
| 3,082,732 | 3/1963 | Stallman | 440/42 |
| 3,090,346 | 5/1963 | Burgin | 440/32 |
| 3,212,258 | 10/1965 | Gongwer . | |
| 3,520,270 | 7/1970 | Miller | 440/89 X |
| 3,933,114 | 1/1976 | Horn | 440/88 |
| 4,794,995 | 1/1989 | Matson et al. | 239/600 X |

*Primary Examiner*—Sherman Basinger

*Attorney, Agent, or Firm*—Michael, Best & Friedrich

[57] ABSTRACT

A marine propulsion device comprising a propulsion unit adapted to be mounted on the transom of a boat for pivotal movement relative thereto about a generally vertical steering axis, the propulsion unit comprising a lower unit rotatably supporting a propeller shaft adapted to support a propeller, a conduit for providing a discharge of fluid from the propulsion unit, and a nozzle for selectively varying the direction, relative to the lower unit, of the discharge.

18 Claims, 1 Drawing Sheet

MARINE PROPULSION DEVICE WITH DIRECTABLE TELLTALE DISCHARGE

RELATED APPLICATION

Attention is directed to Ser. No. 479,936, filed Feb. 14, 1990.

BACKGROUND OF THE INVENTION

The invention relates to marine propulsion devices, and more particularly to marine propulsion devices having a "telltale" discharge or overboard indicator that can be seen by the operator and that indicates that the water pump is pumping cooling water to the engine.

Since it is conventional to locate the helm on the starboard side of a boat, conventional outboard motors have a telltale discharge on the starboard side of the motor.

SUMMARY OF THE INVENTION

The invention provides a marine propulsion device comprising a propulsion unit adapted to be mounted on the transom of a boat for pivotal movement relative thereto about a generally vertical steering axis, the propulsion unit comprising a lower unit rotatably supporting a propeller shaft adapted to support a propeller, means for providing a discharge of fluid from the propulsion unit, and means for selectively varying the direction, relative to the lower unit, of the discharge.

The invention also provides a marine propulsion device comprising a propulsion unit adapted to be mounted on the transom of a boat for pivotal movement relative thereto about a generally vertical steering axis, the propulsion unit including a lower unit rotatably supporting a propeller shaft adapted to support a propeller, and an internal combustion engine which is supported by the lower unit, which is drivingly connected to the propeller shaft, and which includes an engine block defining a cooling jacket, a conduit extending from the engine block and having therein a bore communicating with the cooling jacket, and a nozzle rotatably housed in the bore.

The invention also provides an outboard motor comprising a mounting assembly adapted to be mounted on the transom of a boat, a propulsion unit mounted on the mounting assembly for pivotal movement relative thereto about a generally vertical steering axis, the propulsion unit including a lower unit rotatably supporting a propeller shaft adapted to support a propeller, and an internal combustion engine which is supported by the lower unit, which is drivingly connected to the propeller shaft, and which includes an engine block defining a cooling jacket, a conduit extending from the engine block and having therein a bore communicating with the cooling jacket, and a nozzle which includes a longitudinal axis and a discharge passageway communicating with the bore and extending transversely to the axis, and which is housed in the bore for rotation about the axis.

A principal feature of the invention is the provision of means for selectively varying the direction of the overboard indicator of an outboard motor. This permits, for example, the overboard indicator to be directed between port and starboard or to the side of a boat on which the helm is located.

Other features and advantages of the invention will become apparent to those skilled in the art upon review of the following detailed description, claims, and drawings.

THE DRAWINGS

Figure 1:
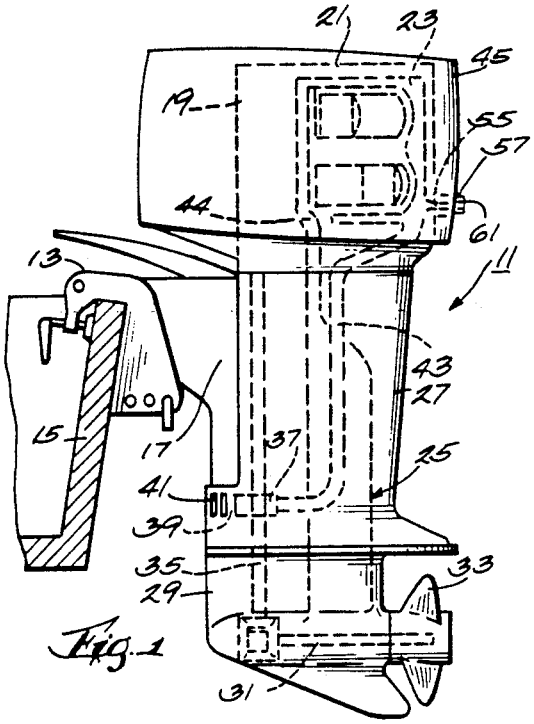
FIG. 1 is a side elevational view, partially in section, of an outboard motor.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown the drawings is a marine propulsion device in the form of an outboard motor 11 including bracket means 13 adapted to be attached to a boat transom 15 and a propulsion unit 17 connected to the bracket means 15 for a pivotal movement about a generally vertically steering axis and about a generally horizontal tilting axis.

Figure 3:
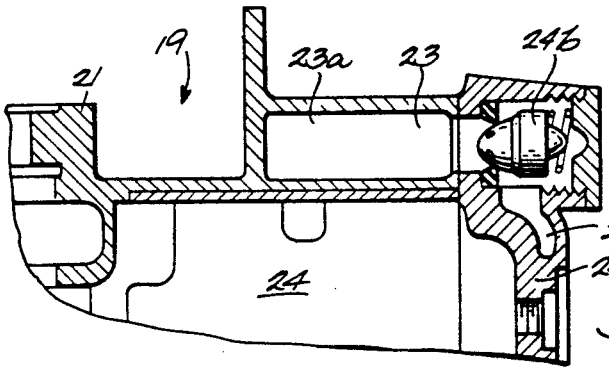
FIG. 3 is a partial sectional view of the engine of the marine propulsion device.

The propulsion unit 17 includes an internal combustion engine 19 comprising an engine block 21 defining an interior cooling jacket 23. Any suitable engine construction can be employed. In the preferred embodiment, the engine 19 also comprises (see FIG. 3) a plurality of cylinders 24 and a cylinder head **24*a*. The cooling jacket 23 preferably includes an upstream portion 23*a* surrounding the cylinders 24 and a downstream portion 23*b* within the cylinder head 24*a*. The engine 19 preferably further comprises valve means 24*b* for permitting communication between the upstream and downstream cooling jacket portions 23*a* and 23*b* when the coolant temperature in the upstream portion 23*a* is above a predetermined temperature or when the coolant pressure in the upstream portion 23*a* is above a predetermined pressure and for substantially preventing communication between the upstream and downstream portions 23*a* and 23*b* when the coolant temperature in the upstream portion 23*a* is below the predetermined temperature and the coolant pressure in the upstream portion 23*a*** is below the predetermined pressure. Such valve means is known in the art and will not be described in further detail.

The propulsion unit 17 also includes a lower unit 25 comprising a drive shaft housing 27 which, at its upper end, supports the engine block 21, and which, at its lower end, has attached thereto a gear case 29 which rotatably supports a propeller shaft 31 having mounted thereon a propeller 33. The propeller shaft 31 is drivingly connected to the engine 19 via a drive shaft 35 rotatably supported in the drive shaft housing 27.

The propulsion unit 17 also includes a pump 37 for supplying coolant to the engine cooling jacket 23. Any suitable pump, preferably driven by the drive shaft 35, can be employed.

Figure 2:
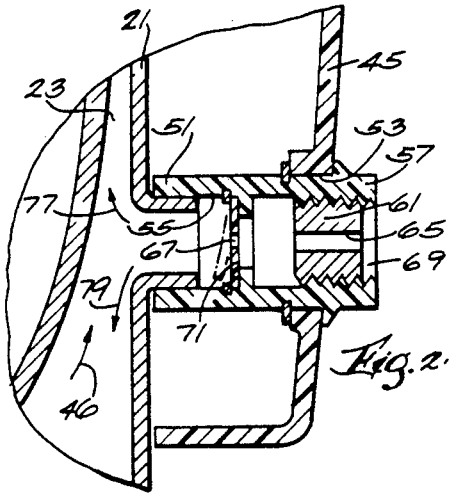
FIG. 2 is an enlarged fragmentary view of a portion of the marine propulsion device shown in FIG. 1.

The pump 37 communicates with an inlet conduit 39 leading to a water intake 41 in the lower unit 25. In addition, a coolant supply conduit 43 extends from the pump 37 to the cooling jacket 23 to supply coolant to the cooling jacket 23 in response to drive shaft rotation. Normal coolant flow from the pump 37 to the cooling jacket 23 is indicated in FIG. 2 by an arrow 46.

Extending from the cooling jacket 23 and shown schematically is a conduit 44 for discharging coolant from the cooling jacket 23. Any suitable construction can be employed.

Supported by the propulsion unit 17, and in enclosing relation to the engine 19, is a cover or cowl 45. Any suitable cowl construction can be employed.

As thus far described, the construction is conventional.

The propulsion unit 17 also includes means facilitating flushing of the cooling jacket 23 and including means for readily attaching and detaching the male end of a common garden hose so as to enable supply of flushing water to the cooling jacket 23.

More specifically, in this last regard, while other specific constructions can be employed, in the disclosed construction, such flushing means comprises a conduit 51 extending from the engine block 21 and through an opening 53 in the cowl or cover 45, which conduit 51 includes an internal passage 55 communicating with the cooling jacket 23 and having an outer end 57 which is provided with an internal thread adapted to receive the male end of a common garden hose.

Removably located in the outer end 57 of the internal passage 55 is a threaded plug 61 which, when threaded into the passage 55, closes the passage 55 to generally prevent the escape of coolant from the cooling jacket 23.

Preferably, the plug 61 includes means in the form of a relatively small axially extending restricted bore 65 for draining a restricted amount of coolant from the cooling jacket 23.

In addition, the plug 61 includes, on the outer surface thereof, a recess 69, such as a diametric slot, adapted for receipt of a tool, such as a screw driver, for effecting rotation of the plug 61 relative to the passage 55, and thereby to enable removal of the plug 61 from the passage 55 and to enable tightly seating the plug 61 in the passage 55 to prevent coolant flow from the cooling jacket 23 between the plug 61 and the passage 55.

It is particularly noted that passage of the conduit 51 through the opening 53 in the cover 45 enables flushing of the engine 19 without requiring removal of the cover 45. Of course, at least some of the advantages of the invention can be provided if the passage 55 terminates inside the cover 45, whereby the cover is removed to afford flushing of the engine 19.

Preferably, the passage 55 is also provided with means for preventing outflow of coolant from the cooling jacket 23 when the plug 61 is removed and for permitting inflow of water to the cooling jacket 23 when the plug 61 is removed. While various other constructions can be employed, such as a ball check valve, in the disclosed construction, such means comprises a reed valve 71. If desired, the reed valve 71 can be provided with a small aperture 67 to afford limited coolant flow from the cooling jacket 23 and through the bore 65 to the exterior of the cover 45 so as to provide an overboard indicator or tell-tale.

In operation, when it is desired to flush the engine 19, the plug 61 is initially removed from the passage 55 in the conduit 51, and in place thereof, the male end of a common garden hose is threadably inserted. Turning on the supply of water to the garden hose will thus open the reed valve 71 and will effect flushing of the cooling jacket 23 of the engine 19. Thus, the flushing means also includes means for supplying coolant to the cooling jacket 23 without operating either the engine 19 or the pump 37, and means for attaching and detaching a common garden hose at a location downstream of the pump 37.

Water flow from the garden hose to the cooling jacket 23 is indicated in FIG. 2 by an arrow 77. Some water from the garden hose also flows "backward" through the conduit 43 to the water pump 37. This water is indicated in FIG. 2 by an arrow 79. The water pump 37 acts as a valve that is substantially, but not completely, closed. The pressure from the garden hose is sufficient to deflect the vanes in the water pump 37 so that a small amount of water flows through the water pump 37 and out the water inlet 41. The pressure from the garden hose is also sufficient to "blow off" or open the valve means **24*b*, so that most of the water supplied by the garden hose flows through the cooling jacket 23, flushes the cooling jacket 23 of salt water or debris, and is discharged through the normal outlet 44. Since some water is supplied to the water pump 37 during flushing, the engine 19 can be operated during flushing without damaging the water pump 37**.

When the flushing is completed, the male end of the common garden hose can be threadably removed from the conduit 51. During such removal, loss of fluid from the cooling jacket 23 is prevented by the reed valve 71. After the male end of the garden hose is removed, the plug 61 can be reinserted and tightened in order to prevent undue stress on the reed valve and, if provided with a restricted bore 65, to provide a tell-tale indicating that the pump is working. If the outboard motor 11 is operated before the plug 61 is replaced, the reed valve 71 prevents water supplied by the pump 37 from flowing out through the passage 55 before flowing through the engine cooling jacket 23.

Figure 4:
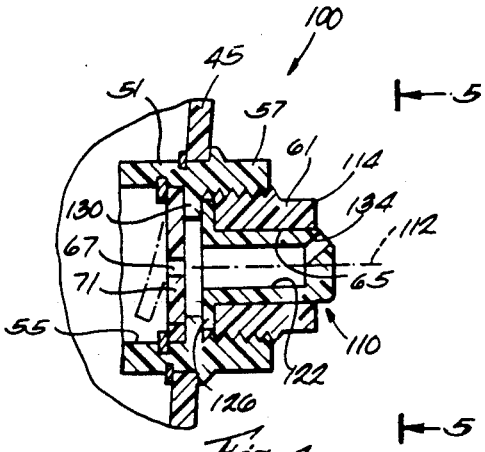
FIG. 4 is a view similar to FIG. 2 showing an outboard motor embodying the invention.
Figure 5:
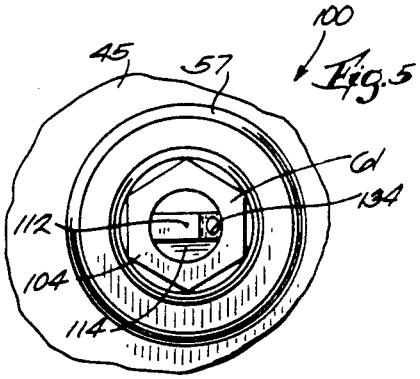
FIG. 5 is a view taken along line 5—5 in FIG. 4.
Figure 6:
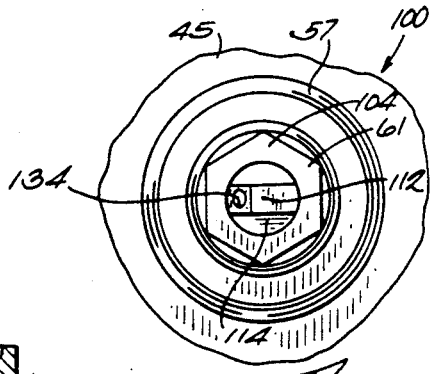
FIG. 6 is a view similar to FIG. 5 with the nozzle aimed in the opposite direction.

An outboard motor 100 embodying the invention is partially illustrated in FIGS. 4 through 6. Except as described below, the outboard motor 100 is substantially identical to the outboard motor 11, and common elements have been given the same reference numerals.

The plug 61 of the outboard motor 100 includes (see FIG. 5) a hex-head 104, rather than a diametric slot. The hex-head 104 is adapted to be engaged by a conventional tool, such as a wrench, for effecting rotation of the plug 61 relative to the passage 55.

The outboard motor 100 comprises means for providing a discharge of fluid from the propulsion unit 17, and means for selectively varying the direction, relative to the lower unit 25, of the discharge. While various suitable means can be employed (for example, the discharge providing means could provide a discharge of idle exhaust gases at a location above the surface of the water in which the outboard motor 100 is operating), in the preferred embodiment, the discharge providing means provides a discharge of cooling water, i.e., a telltale discharge or overboard indicator, at a location above the surface of the water in which the outboard motor 100 is operating. Preferably, the discharge providing means and the varying means include the bore or passage 65 in the plug 61, and a nozzle 110 which has a longitudinal axis 112 and which is housed in the bore 65 for rotation relative to the plug 61 about the axis 112. The nozzle 110 includes a generally cylindrical body 114 having therein an axial bore 122 extending along the axis 112. The nozzle 110 also has inner and outer or left and right ends (as shown in FIG. 4), and the nozzle 110 includes, on its left or inner end, an annular, radially outwardly extending flange 126. The flange 126 is captured between the inner end of the plug 61 and an annular, radially inwardly extending projection 130 inside the conduit 51. The right or outer end of the nozzle 110 is substantially closed and has therein a relatively small discharge passageway 134 extending transversely to the longitudinal axis 112 and communicating between the axial bore 122 and the atmosphere. Rotation of the nozzle 110 relative to the conduit 51 varies the direction (e.g., left, right, up or down) in which the discharge passageway 134 extends. During operation of the outboard motor 100, coolant flows through the passageway 55, the nozzle bore 122 and the nozzle discharge passageway 134 so as to provide a telltale discharge.

When the plug 61 is tightened against the flange 126, which is captured between the plug 61 and the projection 130, rotation of the flange 126 (and thus the nozzle 110) relative to the plug 61 and to the conduit 51 is substantially prevented. When the plug 61 is backed off the flange 126 in the direction of removal of the plug 61 from the passageway 55, rotation of the flange 126 (and thus the nozzle 110) relative to the plug 61 and to the conduit 51 is permitted.

Accordingly, the orientation of the nozzle 110 is selected before the plug 61 is tightened against the flange 126, and then the plug 61 is tightened against the flange 126 to substantially fix the nozzle 110 in position. The telltale discharge can be aimed to the right (FIG. 4), to the left (FIG. 5), or aft (which might be desired if the noise of the discharge stream is objectionable).

Various of the features of the invention are set forth in the following claims.

We claim:

1. A marine propulsion device comprising a propulsion unit adapted to be mounted on the transom of a boat for pivotal movement relative thereto about a generally vertical steering axis, said propulsion unit comprising a lower unit rotatably supporting a propeller shaft adapted to support a propeller, means for providing, independently of exhaust discharge, a telltale discharge of cooling liquid from said propulsion unit, and means for selectively varying the direction, relative to said lower unit, of said discharge.

2. A marine propulsion device as set forth in claim 1 wherein said marine propulsion device is adapted to operate in a body of water having a surface, and wherein said discharge providing means provides said discharge at a location above the surface of the water.

3. A marine propulsion device as set forth in claim 1 wherein said propulsion unit also includes an internal combustion engine which is supported by said lower unit, which is drivingly connected to said propeller shaft, and which includes a cooling jacket, and wherein said discharge providing means communicates with said cooling jacket.

4. A marine propulsion device which is adapted to operate in a body of water having a surface, and which comprises a propulsion unit adapted to be mounted on the transom of a boat for pivotal movement relative thereto about a generally vertical steering axis, said propulsion unit comprising a lower unit rotatably supporting a propeller shaft adapted to support a propeller, an internal combustion engine which includes an engine block defining a cooling jacket, which is supported by said lower unit, and which is drivingly connected to said propeller shaft, means for providing a telltale discharge of cooling liquid from said propulsion unit at a location above the surface of the water, and means for selectively varying the direction, relative to said lower unit, of said discharge, said discharge providing means and said direction varying means including a conduit having therein a bore communicating with said cooling jacket, and a nozzle rotatably housed in said bore.

5. A marine propulsion device as set forth in claim 4 wherein said nozzle includes a longitudinal axis, and a discharge passageway communicating with said bore and extending transversely to said axis, and wherein said nozzle is supported for a rotation about said axis.

6. A marine propulsion device as set forth in claim 5 and further comprising means for selectively preventing rotation of said nozzle relative to said conduit.

7. A marine propulsion device as set forth in claim 5 wherein said means also include a plug which is received in said conduit bore and which has therein an axial bore, and wherein said nozzle is rotatably housed in said plug bore.

8. A marine propulsion device comprising a propulsion unit adapted to be mounted on the transom of a boat for pivotal movement relative thereto about a generally vertical steering axis, said propulsion unit including a lower unit rotatably supporting a propeller shaft adapted to support a propeller, and an internal combustion engine which is supported by said lower unit, which is drivingly connected to said propeller shaft, and which includes an engine block defining a cooling jacket, a conduit extending from said engine block and having therein a bore communicating with said cooling jacket, and a nozzle which is rotatably housed in said bore and which communicates with said conduit and directly with the atmosphere.

9. A marine propulsion device as set forth in claim 8 wherein said marine propulsion device is adapted to operate in a body of water having a surface, and wherein said nozzle is located above the surface of the water.

10. A marine propulsion device as set forth in claim 8 wherein said nozzle includes a longitudinal axis, and a discharge passageway communicating with said bore and extending transversely to said axis, and wherein said nozzle is supported for a rotation about said axis.

11. A marine propulsion device as set forth in claim 10 and further comprising means for selectively preventing rotation of said nozzle relative to said conduit.

12. A marine propulsion device as set forth in claim 11 and further comprising a plug which is received in said conduit bore and which has therein an axial bore, and wherein said nozzle is rotatably housed in said plug bore.

13. An outboard motor comprising a mounting assembly adapted to be mounted on the transom of a boat, a propulsion unit mounted on said mounting assembly for pivotal movement relative thereto about a generally vertical steering axis, said propulsion unit including a lower unit rotatably supporting a propeller shaft adapted to support a propeller, and an internal combustion engine which is supported by said lower unit, which is drivingly connected to said propeller shaft, and which includes an engine block defining a cooling jacket, a conduit extending from said engine block and having therein a bore communicating with said cooling jacket, and a nozzle which includes a longitudinal axis and a discharge passageway communicating with said bore and extending transversely to said axis, and which is housed in said bore for rotation about said axis.

14. An outboard motor as set forth in claim 13 and further comprising means for selectively preventing rotation of said nozzle relative to said conduit.

15. An outboard motor as set forth in claim 13 and further comprising a plug which is received in said conduit bore and which has therein an axial bore, and wherein said nozzle is rotatably housed in said plug bore.

16. A marine propulsion device which is adapted to operate in a body of water having a surface and which comprises a propulsion unit adapted to be mounted on the transom of a boat for pivotal movement relative thereto about a generally vertical steering axis, said propulsion unit comprising a lower unit rotatably supporting a propeller shaft adapted to support a propeller, means for providing a telltale discharge of cooling fluid from said propulsion unit at a location that is at all times above the surface of the water, and means for selectively varying the direction, relative to said lower unit, of said discharge.

17. A marine propulsion device comprising a propulsion unit adapted to be mounted n the transom of a boat for pivotal movement relative thereto about a generally vertical steering axis, said propulsion unit comprising a lower unit rotatably supporting a propeller shaft adapted to support a propeller, means for providing a telltale discharge of cooling fluid from said propulsion unit, and means for selectively varying the direction, relative to said lower unit and between port and starboard, of said discharge.

18. A marine propulsion device as set forth in claim 17 wherein said propulsion unit also includes an internal combustion engine which is supported by said lower unit, which is drivingly connected to said propeller shaft, and which includes a cooling jacket, and wherein said discharge providing means communicates with said cooling jacket.

* * * * *